US009610783B2

(12) United States Patent
Fujisawa

(10) Patent No.: US 9,610,783 B2
(45) Date of Patent: Apr. 4, 2017

(54) LIGHT IRRADIATION DEVICE AND PRINTING APPARATUS

(71) Applicant: SEIKO EPSON CORPORATION, Tokyo (JP)

(72) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/970,143

(22) Filed: Dec. 15, 2015

(65) Prior Publication Data

US 2016/0193853 A1 Jul. 7, 2016

(30) Foreign Application Priority Data

Jan. 7, 2015 (JP) ..... 2015-001355

(51) Int. Cl.
*B41J 11/00* (2006.01)
*B65H 20/00* (2006.01)

(52) U.S. Cl.
CPC ..... *B41J 11/002* (2013.01)

(58) Field of Classification Search
CPC ..... B41J 11/002; B65H 20/00
See application file for complete search history.

(56) References Cited

U.S. PATENT DOCUMENTS

2007/0013757 A1* 1/2007 Ohnishi ..... B41J 11/002 347/102

FOREIGN PATENT DOCUMENTS

| | | |
|---|---|---|
| JP | 2005-153193 | 6/2005 |
| JP | 2008-180842 | 8/2008 |
| JP | 2009-126071 | 6/2009 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A light irradiation device includes: a UV irradiation unit that applies light to UV ink having been applied onto a medium; and a moving unit that moves a relative position of the medium and the UV irradiation unit in the Z-axis direction; wherein the UV irradiation unit includes, a light source row formed by arranging plural light emitting diodes (LED), irradiation intensity of which falls within a first range, in the Y-axis direction orthogonal to the Z-axis direction; and another light source row located next to the light source row and formed by arranging plural LEDs, irradiation intensity of which falls within a second range, in the Y-axis direction.

20 Claims, 8 Drawing Sheets

LIGHT IRRADIATION DEVICE AND PRINTING APPARATUS

BACKGROUND

1. Technical Field

The present invention relates to a light irradiation device, and a printing apparatus provided with the light irradiation device.

2. Related Art

A printing apparatus (for example, an ink-jet printer) according to related art applies photo-curable ink (for example, ultraviolet-ray curable ink) onto a medium to form a print image, and, after that, irradiates the print image with light (for example, ultraviolet rays) by means of a light irradiation device for image fixation (the curing of the applied photo-curable ink). In such a printing apparatus, if the amount of light irradiation to photo-curable ink is insufficient, a print image is not fixed sufficiently. Therefore, it is necessary that a light irradiation device should be configured to irradiate, with light uniformly and sufficiently, the entire surface of a medium onto which photo-curable ink has been applied. In addition, it is necessary to maintain such a uniform and sufficient irradiation state. In connection with this, a technique (illumination device) that can make the distribution of illuminance uniform by arranging light emission elements classified into different levels of luminous intensity (irradiation intensity) on the basis of a predetermined arrangement rule is disclosed in JP-A-2008-180842.

However, in the illumination device disclosed in JP-A-2008-180842, if the difference in luminous intensity (irradiation intensity) among the classified light emission elements is excessively large, a problem of the lack of uniformity in irradiation occurs even if the light emission elements are arranged on the basis of a predetermined rule. That is, in order to avoid this problem, it is necessary that the illumination device should be made up of groups of light emission elements whose difference in luminous intensity (irradiation intensity) falls within a predetermined range. For this reason, for example, in some cases, variations among the manufacturing lots of light emission elements are not tolerable.

SUMMARY

The invention can be embodied in the following application examples or modes.

First Application Example

A light irradiation device according to this application example comprises: a light irradiation section that applies light to photo-curable ink having been applied onto a medium; and a moving section that moves a relative position of the medium and the light irradiation section in a first direction; wherein the light irradiation section includes, a first light source row formed by arranging plural first light sources, irradiation intensity of which falls within a first range, in a second direction orthogonal to the first direction; and a second light source row located next to the first light source row and formed by arranging plural second light sources, irradiation intensity of which falls within a second range, in the second direction.

With this application example, even if the difference between the irradiation intensity in the first range and the irradiation intensity in the second range is large (for example, even if the difference between the average irradiation intensity of the first light sources and the average irradiation intensity of the second light sources is large), it is possible to, at least, suppress the amount of irradiation to the medium to be not greater than the sum of individual variations in the amount of irradiation by the first light sources and the amount of irradiation by the second light sources.

Second Application Example

In the light irradiation device according to the above application example, light sources of the light irradiation section, which include the first light sources and the second light sources, may be divided into plural row groups in the second direction; and the light irradiation section may include a driver circuit that drives and controls the light sources in each of the groups.

With this application example, even if the difference between the irradiation intensity in the first range and the irradiation intensity in the second range is large, and even if there are variations in the amount of irradiation by the first light sources and variations in the amount of irradiation by the second light sources, it is possible to make an adjustment for achieving a uniform amount of irradiation to the medium.

Third Application Example

In the light irradiation device according to the above application example, the light irradiation section may further include a third light source row formed by arranging the second light sources in the second direction and located next to the first light source row; wherein the irradiation intensity of the first light source row may be greater than the irradiation intensity of the second light source row and irradiation intensity of the third light source row; and wherein the first light source row may be located between the second light source row and the third light source row.

This application example makes it possible to heighten peak illuminance, thereby realizing the fixation (curing) of UV ink that requires irradiation light having higher peak illuminance for the fixation (curing).

Fourth Application Example

In the light irradiation device according to the above application example, the light irradiation section may further include a third light source row formed by arranging the second light sources in the second direction and located next to the first light source row; wherein the irradiation intensity of the first light source row may be less than the irradiation intensity of the second light source row and irradiation intensity of the third light source row; and wherein the first light source row may be located between the second light source row and the third light source row.

This application example makes it possible to widen the range of light irradiation, resulting in more efficient fixation (curing) of the photo-curable ink.

Fifth Application Example

In the light irradiation device according to the above application example, the first light sources and the second light sources may be light emitting diodes.

Since light emitting diodes are used in this application example, it is easier to construct the first light sources and the second light sources.

Sixth Application Example

A printing apparatus according to this application example comprises: the light irradiation device according to the above application example; and a printing section that applies the photo-curable ink onto the medium.

In this application example, since the printing apparatus using the photo-curable ink is equipped with the light irradiation device according to the above application example, it is possible to cause the photo-curable ink to become fixed (cure) with greater stability.

Seventh Application Example

In the printing apparatus according to the above application example, the moving section may move the medium in relation to the light irradiation section.

In this application example, since the moving section causes the medium to move in the first direction, it is possible to cause the photo-curable ink having been applied onto the medium to become fixed (cure) with greater uniformity by means of the first light source row and the second light source row in the second direction orthogonal to the first direction.

Eighth Application Example

In the printing apparatus according to the above application example, the printing section may include an ejection head that ejects the photo-curable ink onto the medium; and the ejection head and the light irradiation section can be moved in the second direction.

In this application example, the printing section includes an ejection head that ejects the photo-curable ink onto the medium; and the ejection head and the light irradiation section can be moved in the second direction. Therefore, it is possible to cause the photo-curable ink having been applied onto the medium to become fixed (cure) with greater uniformity by means of the first light source row and the second light source row.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
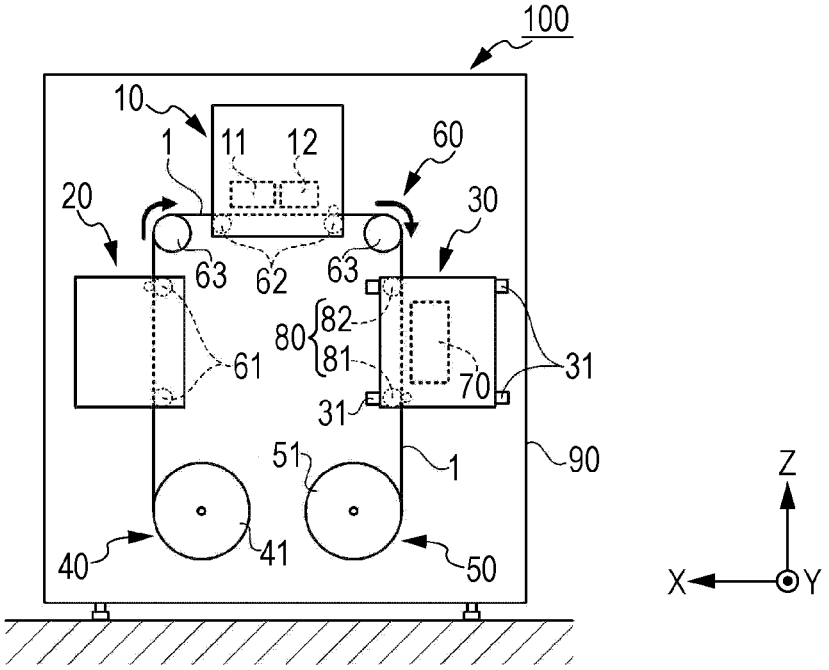
FIG. 1A is a front view that schematically illustrates the structure of a printer, which is a "printing apparatus" according to a first embodiment.

With reference to the accompanying drawings, exemplary embodiments of the present invention will now be explained. The following description shows one exemplary mode of the invention and is not intended to restrict the scope of the invention. In the drawings referred to in the description below, scale different from actual is sometimes used for easier understanding. In the coordinate shown in the drawings, the Z-axis direction represents the vertical direction wherein the +Z direction is the upward direction, the Y-axis direction represents the depth direction wherein the +Y direction is the frontward direction, the X-axis direction represents the horizontal direction wherein the +X direction is the leftward direction, and the X-Y plane is in parallel with the plane on which the printing apparatus is installed.

First Embodiment

Printing Apparatus

Figure 1B:
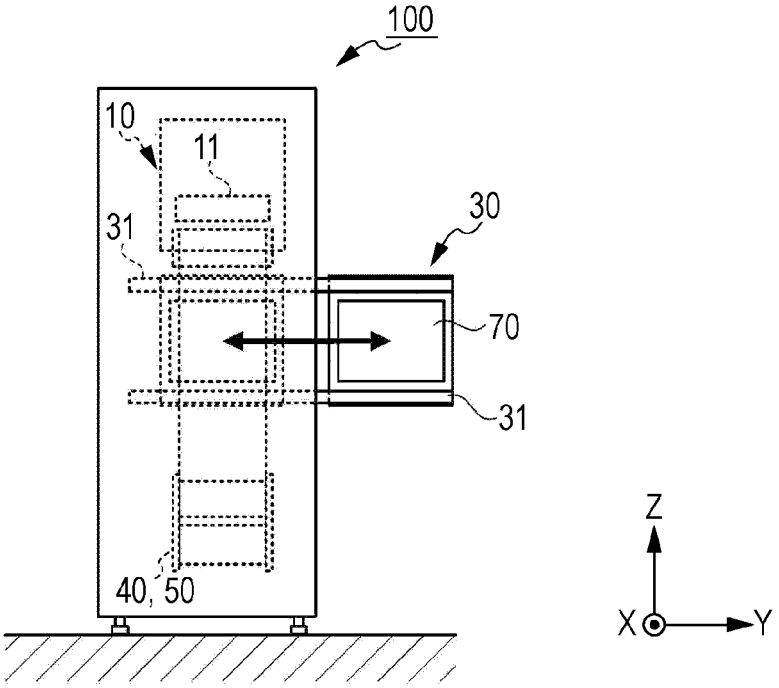
FIG. 1B is a side view thereof.

FIG. 1A is a front view that schematically illustrates the structure of a printer 100, which is a "printing apparatus" according to a first embodiment. FIG. 1B is a side view thereof. The printer 100 is an ink-jet printer that uses ultraviolet-ray curable ink (hereinafter referred to as UV ink), which cures when exposed to ultraviolet rays, as an example of "photo-curable ink", and forms an image on roll paper 1, which is an example of a "medium" and is fed in a state of being unreeled from a roll. The printer 100 includes a printing unit 10, a pretreatment unit 20, a light irradiation device 30, a feeding unit 40, a reeling unit 50, a transportation path 60, and the like. They are housed inside a cabinet 90 of this printing apparatus.

The roll paper 1 onto which print operation is to be performed is fed from the feeding unit 40, and is transported along the transportation path 60, which is formed inside the printer 100, to pass through the pretreatment unit 20, the printing unit 10, and the light irradiation device 30. The roll paper 1 is finally reeled onto the reeling unit 50. For example, high-quality paper, cast paper, art paper, coated paper, artificial paper, or a film made of PET (polyethylene terephthalate) or PP (polypropylene), etc. can be used as the roll paper 1.

The printing unit 10 includes an ejection head 11, which ejects UV ink onto the surface of the roll paper 1 for image printing, and a provisional fixation device 12, which applies ultraviolet rays for provisional fixation (provisional curing) of the UV ink, etc. In the provisional fixation of the UV ink by the provisional fixation device 12, the UV ink is caused to cure (provisionally) to an extent that the spreading of the UV ink that has not been dried yet becomes sufficiently slower in comparison with a case where no ultraviolet rays are applied.

The pretreatment unit 20 is located upstream of the printing unit 10 on the transportation path 60. The pretreatment unit 20 gives pretreatment on the roll paper 1 before the applying of UV ink thereto. The pretreatment is, for example, corona discharging for improving the wettability of UV ink onto the roll paper 1. The pretreatment is not always necessary. Therefore, it is not always necessary to provide the pretreatment unit 20.

The light irradiation device 30 is located downstream of the printing unit 10 on the transportation path 60. The light irradiation device 30 includes a UV irradiation unit 70, which is an example of a "light irradiation section" for non-provisional fixation (non-provisional curing) on the roll paper 1 after the applying of the UV ink and after the provisional fixation, and a transportation unit 80, etc. The UV irradiation unit 70 emits ultraviolet rays whose irradiation intensity is greater than that of the provisional fixation device 12 so as to cause the UV ink to cure non-provisionally (become fixed non-provisionally) to an extent that the fluidity of the UV ink is deprived of.

The feeding unit 40 is a paper accommodation unit on which the paper 1 before pretreatment is set in a roll shape. The feeding unit 40 is located upstream of the pretreatment unit 20 on the transportation path 60, and includes an unreeling reel 41, etc. The unreeling reel 41 rotates when driven by an unreeling motor (not illustrated in the drawing), thereby unreeling the roll paper 1 toward the pretreatment unit 20, which is located downstream of the feeding unit 40.

The reeling unit 50 is a paper take-up unit onto which the roll paper 1 after the non-provisional fixation is reeled. The reeling unit 50 is located downstream of the light irradiation device 30 on the transportation path 60, and includes a reeling reel 51, etc. The reeling reel 51 rotates when driven by a reeling motor (not illustrated in the drawing), thereby reeling the roll paper 1 coming from the light irradiation device 30, which is located upstream of the reeling unit 50.

The transportation path 60 is a path along which the roll paper 1 is transported from the feeding unit 40 to the reeling unit 50 via the pretreatment unit 20, the printing unit 10, and the light irradiation device 30 in this order. The transportation path 60 includes a transportation unit 61 of the pretreatment unit 20, a transportation unit 62 of the printing unit 10, turn-in-the-path rollers 63, and a transportation unit 80 of the light irradiation device 30, etc. The transportation unit 61, 62 includes a driving roller with a nip roller, and a driven roller, etc. The driving roller applies a force for movement of the roll paper 1 in the transportation direction. The driven roller rotates by following the rotation of the driving roller, which is located at the downstream side. The turn-in-the-path rollers 63 are driven rollers for bending the transportation path 60. The upstream turn-in-the-path roller 63 changes the direction of transportation from the Z-axis direction between the feeding unit 40 and the pretreatment unit 20 into the horizontal direction (X-axis direction) at the printing unit 10. The downstream turn-in-the-path roller 63 changes the direction of transportation from the horizontal direction (X-axis direction) at the printing unit 10 into the Z-axis direction between the light irradiation device 30 and the reeling unit 50.

The transportation unit 80 is a unit that causes the roll paper 1 to move at the light irradiation device 30. The transportation unit 80 includes a driving roller 81 with a nip roller, and a driven roller 82, etc. At the ultraviolet irradiation area of the UV irradiation unit 70, the transportation unit 80 transports the roll paper 1 in the Z-axis direction, which is an example of a "first direction", while keeping a predetermined fixed distance between the surface of the roll paper 1 onto which the UV ink has been applied and the light sources of the UV irradiation unit 70. That is, the transportation unit 80 is an example of a "moving section" that moves the relative position of the roll paper 1 and the UV irradiation unit 70 in the "first direction".

Light Irradiation Section

In order to cause the UV ink having been applied onto the roll paper 1 by the printing unit 10 to cure on the transportation path 60, as illustrated in FIG. 1A, the light source array plane of the UV irradiation unit 70, which is an example of a "light irradiation section", is provided at a facing position substantially in parallel with, and at a predetermined distance from, the surface of the roll paper 1 supported on the transportation path 60, and the UV irradiation unit 70 is movably supported by stays 31 inside the cabinet 90. The UV irradiation unit 70 emits light in the +X direction, which is the main direction of irradiation toward the roll paper 1.

If the irradiation intensity of the UV irradiation unit 70 decreases, it becomes difficult to cause the UV ink to cure sufficiently. Therefore, periodical maintenance is necessary. The stays 31 are extendable in the +Y direction as illustrated in FIG. 1B so that the UV irradiation unit 70 can be drawn out to the outside of the cabinet 90 when periodical maintenance of the UV irradiation unit 70 is conducted.

Figure 2A:
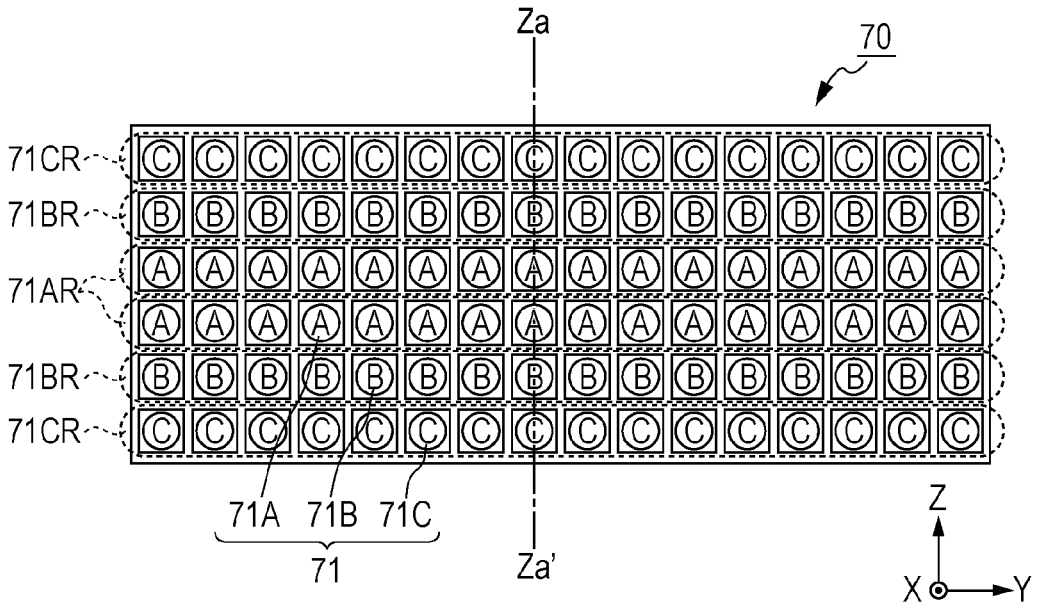
FIG. 2A is a front view that illustrates the structure of an LED array of a UV irradiation unit, which is an example of a "light irradiation section".
Figure 2B:
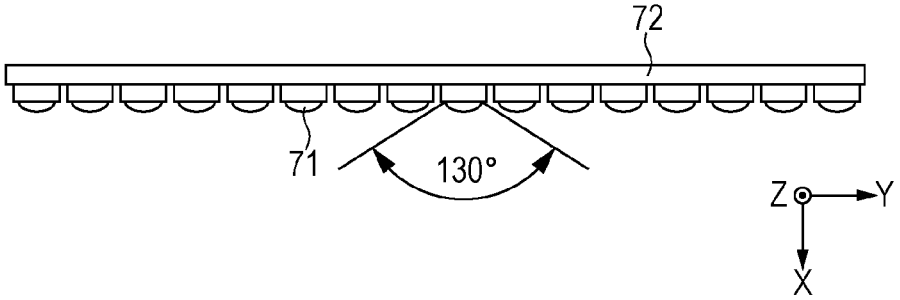
FIG. 2B is a side view thereof.

FIG. 2A is a front view that illustrates the structure of an LED array of the UV irradiation unit 70. FIG. 2B is a side view thereof. The coordinate system illustrated in the drawing corresponds to a coordinate system obtained when the UV irradiation unit 70 is mounted in the printer 100 illustrated in FIG. 1A, 1B.

The UV irradiation unit 70 includes an LED array, and a driver circuit 73 (described later) for driving the LED array, etc. The LED array is an array of light emitting diodes 71 (hereinafter referred to as LEDs 71) on a substrate 72. The LEDs 71 are light sources that can emit light containing light components in the wavelength region of ultraviolet rays. Though an LED array of six rows counted in the Z direction and sixteen columns counted in the Y direction is illustrated in FIG. 2A, the scope of the invention is not limited thereto. It is necessary that the LED array should have array size that makes it possible to irradiate an irradiation target area corresponding to the size of a target object (medium), to which irradiation light is applied, uniformly with sufficient irradiation intensity (for example, an LED array of ten rows counted in the Z direction and one hundred columns counted in the Y direction (one thousand LEDs)). In a preferred example, as illustrated in FIG. 2B, a lens that has an angle of irradiation (half-value angle) of 130° is mounted on each of the LEDs 71.

The individual irradiation intensity of the LEDs 71 could differ from one to another because of manufacturing variations. Accordingly, for example, grouping into some ranks of irradiation intensity based on variations among manufacturing lots can be made. This means that, even if the difference in irradiation intensity between one rank and another rank is comparatively large, it is possible to group the LEDs 71 in such a way as to ensure that variations within each individual rank are small. Therefore, in the present embodiment, the LEDs 71 are arranged with grouping, wherein each rank corresponds to a predetermined range of irradiation intensity.

Specifically, the LEDs 71 are ranked as follows on the basis of irradiation intensity:

Rank A: LEDs 71A, which constitute an example of "first light sources", belong to this group; the irradiation intensity of these LEDs falls within a predetermined range, which is an example of a "first range";

Rank B: LEDs 71B, which constitute an example of "second light sources", belong to this group; the irradiation intensity of these LEDs falls within, as an example of a "second range", a predetermined range in which irradiation is less intense than the "first range"; and Rank C: LEDs 71C belong to this group; the irradiation intensity of these LEDs falls within a predetermined range in which irradiation is less intense than the "second range". The number of the ranks is not limited to three mentioned above.

The LEDs 71 of these ranks are arranged as illustrated in FIG. 2A. That is, the LEDs 71 of the same rank are arranged in the Y-axis direction (second direction), which is orthogonal to the Z-axis direction (first direction). In the Z-axis direction (first direction), the LEDs 71 of different ranks are arranged in such a way that, in each column, irradiation intensity increases toward the inner LEDs in the array. Specifically, in the example illustrated in FIG. 2A, two light source rows 71AR made up of the LEDs 71A of the rank A are located at the center area in the Z-axis direction. One light source row 71BR made up of the LEDs 71B of the rank B is located next to and outside each one of the two light source rows 71AR in the Z-axis direction. One light source row 71CR made up of the LEDs 71C of the rank C is located next to and outside each one of the two light source rows 71BR in the Z-axis direction.

The light source row 71AR is an example of a "first light source row" according to the present invention. That is, the light source row 71AR is a light source row formed by arranging plural first light sources (LEDs 71A), irradiation intensity of which falls within a first range, in the Y-axis direction (second direction) orthogonal to the Z-axis direction (first direction). One of the two light source rows 71BR, each of which is located next to and outside the corresponding one of the two light source rows 71AR, is an example of a "second light source row" according to the present invention. That is, the one of the two light source rows 71BR is a light source row located next to the first light source row and formed by arranging plural second light sources (LEDs 71B), irradiation intensity of which falls within a second range, in the Y-axis direction (second direction). The other of the two light source rows 71BR, each of which is located next to and outside the corresponding one of the two light source rows 71AR, is an example of a "third light source row" according to the present invention. That is, the other of the two light source rows 71BR is a light source row formed by arranging the second light sources (LEDs 71B) in the Y-axis direction (second direction) and located next to the first light source row (light source row 71AR). The irradiation intensity of the first light source row (light source row 71AR) is greater than the irradiation intensity of the second light source row (the one of the two light source rows 71BR) and irradiation intensity of the third light source row (the other of the two light source rows 71BR), and the first light source row (light source row 71AR) is located between the second light source row (the one of the two light source rows 71BR) and the third light source row (the other of the two light source rows 71BR).

Figure 3A:
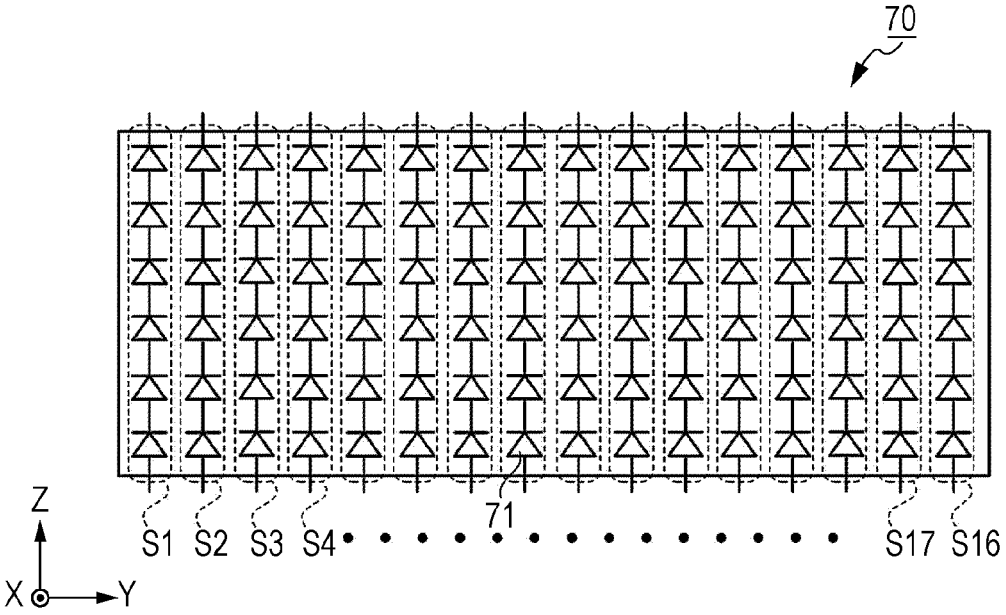
FIG. 3A is a circuit diagram that illustrates an electric connection relationship among light sources (LEDs).
Figure 3B:
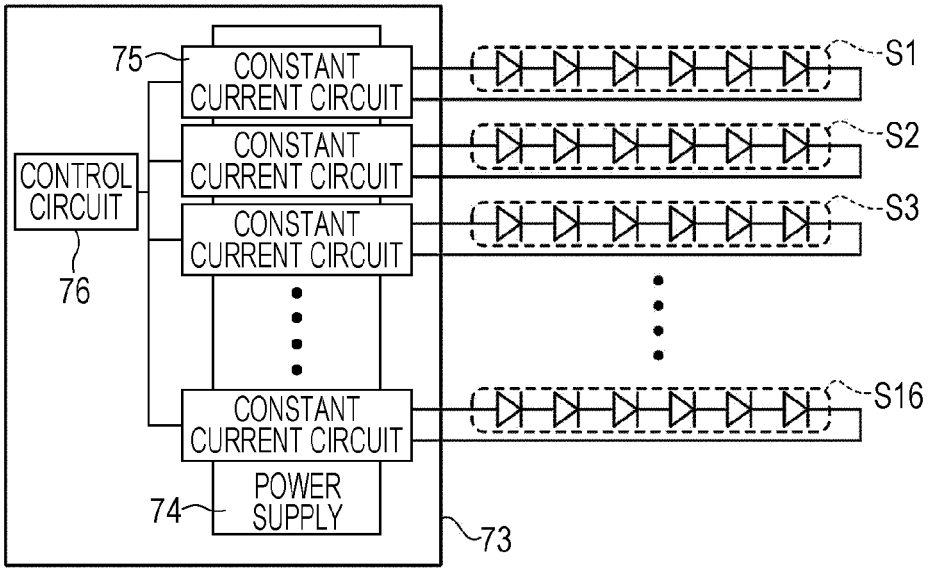
FIG. 3B is a block diagram of a driver circuit.

FIG. 3A is a circuit diagram that illustrates an electric connection relationship among the LEDs 71. FIG. 3B is a block diagram of the driver circuit 73. An electric connection relationship between the driver circuit 73 and the LEDs 71 is additionally illustrated in FIG. 3B.

The light sources of the UV irradiation unit 70, which include the first light sources (LEDs 71A) and the second light sources (LEDs 71B), are divided into plural row groups in the Y-axis direction (second direction). The UV irradiation unit 70 includes a driver circuit that drives and controls the light sources in each of the groups. Specifically, LEDs 71 arranged in one column each in the Z-axis direction (six LEDs 71 in the example illustrated in FIG. 2A) are connected in the forward direction to constitute one circuit group Sn. Plural circuit groups (groups S1 to S16) are arranged in the Y-axis direction (second direction). A constant current circuit 75 is provided individually for each of the circuit groups Sn. A control circuit 76 controls each of the constant current circuits 75. That is, it is possible to make the adjustment of the irradiation intensity of the LEDs 71 for each of the circuit groups Sn of the LEDs 71 connected in series by means of the control circuit 76.

Figure 4:
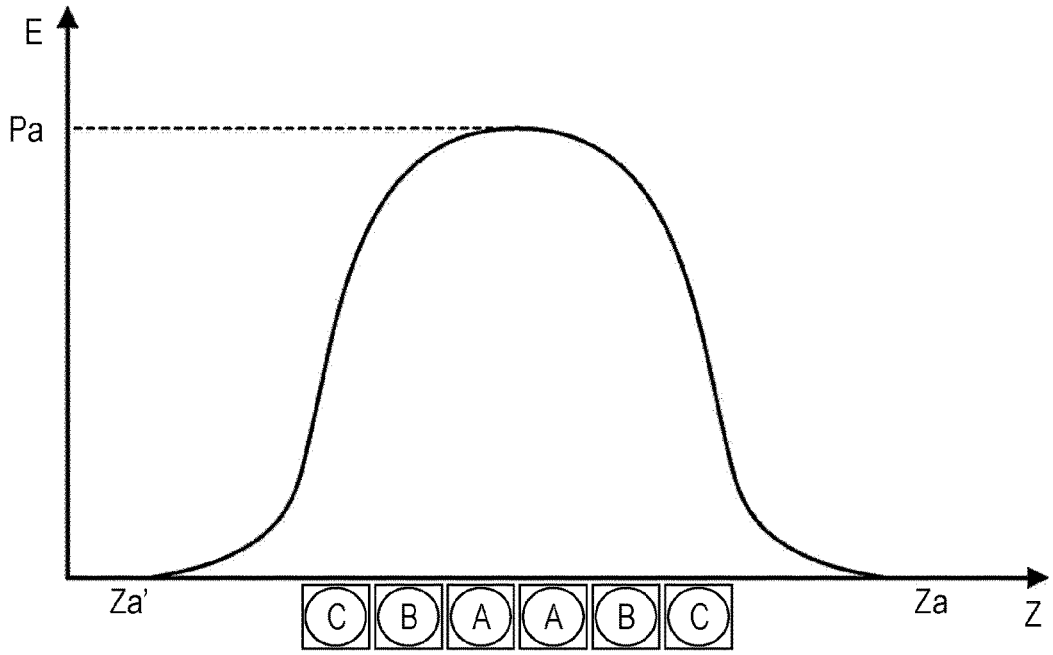
FIG. 4 is a graph that conceptually shows the distribution of the irradiation intensity of light emitted by light sources (LEDs).
Figure 5A:
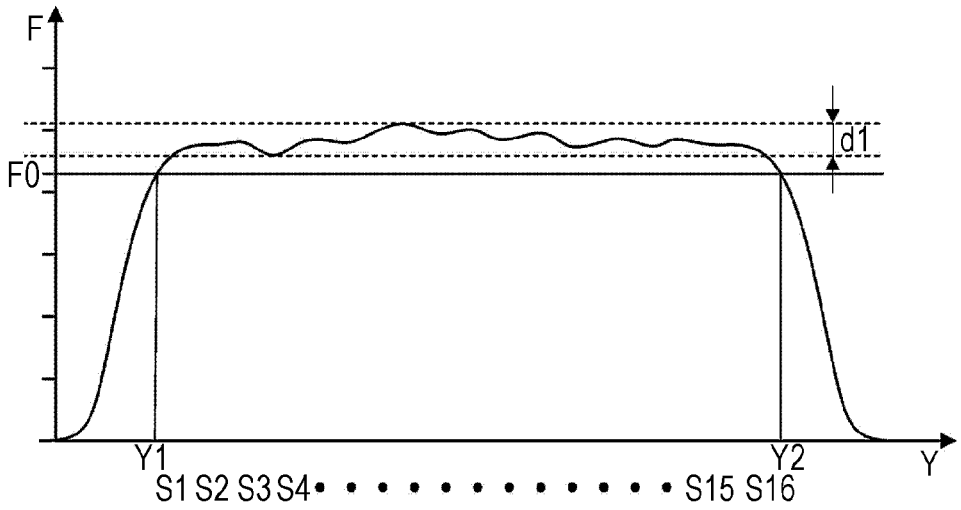
FIG. 5A is a graph that conceptually shows the distribution of the irradiation intensity of light emitted by light sources (LEDs).
Figure 5B:
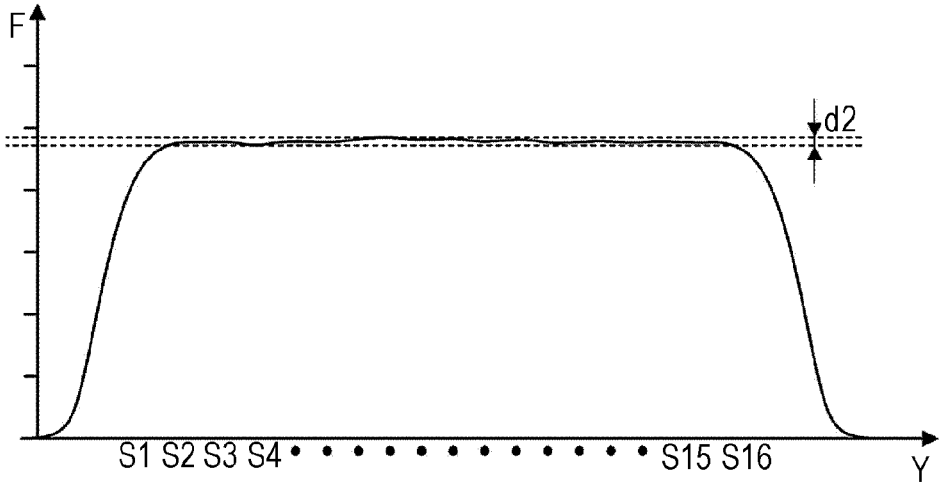
FIG. 5B is a graph that conceptually shows the distribution of the irradiation intensity of light emitted by light sources (LEDs).

Each of FIGS. 4, 5A, and 5B is a graph that conceptually shows the distribution of the irradiation intensity of light emitted by the LEDs 71. The graph of FIG. 4 shows the optical distribution of light emitted by the LEDs 71 arranged in the column Za-Za' of the LED array of the UV irradiation unit 70 illustrated in FIG. 2A. The distribution of irradiation intensity (photoreception intensity) E at positions of photoreception by the roll paper 1 in the Z-axis direction (first direction) is shown in this graph. The LEDs 71A of the rank A, the LEDs 71B of the rank B, and the LEDs 71C of the rank C are arranged in the order illustrated beneath the graph. That is, the LEDs 71 are arranged in such a way that irradiation intensity increases toward the center in the column Za-Za'. For this reason, the distribution has a peak Pa of irradiation intensity at the center.

The distribution in the Y-axis direction (second direction) orthogonal to the Z-axis direction (first direction) is illustrated in FIG. 5A. The graph of FIG. 5A shows the distribution, in the Y-axis direction (second direction), of total energy E of photoreception by the roll paper 1 transported at the irradiation area of the UV irradiation unit 70 by the transportation unit 80. The circuit groups Sn (S1 to S16) of the LEDs 71 are additionally illustrated at the corresponding positions on the Y axis. Let F0 be the energy amount of irradiation light required for sufficient fixation (curing) of UV ink. The roll paper 1 is transported inside an area where an amount of photoreception is in excess of F0 on the Y axis (area Y1-Y2). In other words, on the basis of the width of the roll paper 1 and on the basis of the fixation (curing) characteristics of UV ink applied onto the roll paper 1, the LEDs 71 are arranged and the irradiation intensity of the LEDs 71 is set in such a way as to ensure sufficient fixation (curing) of the UV ink having been applied onto the roll paper 1.

As illustrated in FIG. 2A, the LEDs 71 belonging to the same irradiation-intensity-rank group are arranged in the Y-axis direction (second direction) of the LED array of the UV irradiation unit 70. For this reason, despite the fact that there are rank differences in the irradiation intensity of the LEDs 71 in the Z-axis direction (first direction) orthogonal to the Y-axis direction (second direction), there are no significant variations in the distribution of the total energy of photoreception by the roll paper 1 in the Y-axis direction (second direction). Even if there are some variations in the photoreception energy as illustrated in FIG. 5A, it is possible to, at least, suppress the maximum amplitude d1 of the variations to be not greater than the sum of the individual variations of the individual light source rows (that is, variations in each rank).

The graph of FIG. 5B shows the distribution of photoreception energy in the Y-axis direction (second direction) in a case where variations in irradiation intensity are reduced by the driver circuit 73 (refer to FIG. 3B). The driver circuit 73 can adjust the irradiation intensity of the LEDs 71 for each of the circuit groups Sn of the LEDs 71 by means of the control circuit 76. Therefore, if there are some variations in the distribution in the Y-axis direction (second direction) as illustrated in FIG. 5A, it is possible to reduce the variations by making an adjustment for the circuit groups Sn corresponding to the magnitude of the variations and the positions of the variations (specifically, the adjustment of the amount of an electric current flowing through the LEDs 71).

As described above, a printing apparatus and a light irradiation device according to the present embodiment produce the following effects. With the present embodiment, even if the difference in irradiation intensity between predetermined ranges corresponding to the respective ranks, for example, the "first range" and the "second range", is large, it is possible to, at least, suppress the amount of irradiation to the roll paper 1 to be not greater than the sum of individual variations in the amount of irradiation within the predetermined ranges corresponding to the respective ranks, for example, the "first range" and the "second range".

The light sources of the UV irradiation unit 70 are divided into plural row groups in the Y-axis direction (second direction). The UV irradiation unit 70 includes the driver circuit 73, which drives and controls the light sources in each of the groups. Therefore, even if the difference in irradiation intensity between predetermined ranges corresponding to the respective ranks, for example, the "first range" and the "second range", is large, and even if there are variations in the amount of irradiation by the light sources of each rank, it is possible to make an adjustment for achieving a uniform amount of irradiation to the roll paper 1.

The LEDs 71 are arranged in such a way that irradiation intensity increases toward the center in each column in the Z-axis direction (first direction). The distribution has a peak Pa of irradiation intensity at the center in the Z-axis direction (first direction). Therefore, it is possible to heighten the peak illuminance of the UV irradiation unit 70. This realizes the fixation (curing) of UV ink that requires irradiation light having higher peak illuminance for the fixation (curing).

Since light emitting diodes are used as the light sources, it is easier to construct an LED array.

Since the printer 100 using UV ink is equipped with the light irradiation device 30, it is possible to cause the UV ink to become fixed (cure) with greater stability.

In the present embodiment, the "moving section" is the transportation unit 80, which transports the roll paper 1 to the UV irradiation unit 70, causes the roll paper 1 to move in the Z-axis direction (first direction) at the UV irradiation unit 70, and ejects the roll paper 1 from the UV irradiation unit 70. Since the transportation unit 80 causes the roll paper 1 to move in the Z-axis direction (first direction), it is possible to cause the UV ink having been applied onto the roll paper 1 to become fixed (cure) with greater uniformity by means of each row of the light sources of the same rank in the Y-axis direction (second direction) orthogonal to the Z-axis direction (first direction).

Second Embodiment

Next, a light irradiation device according to a second embodiment, and a printing apparatus provided with the light irradiation device will now be explained. In the description below, the same reference numerals are assigned to the same components as those of the embodiment described above. A redundant explanation is not given here.

Figure 6:
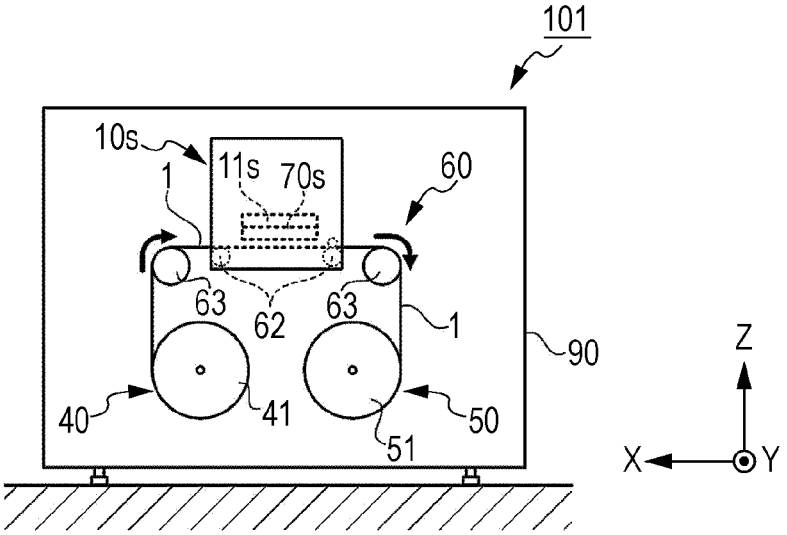
FIG. 6 is a front view that schematically illustrates the structure of a printer, which is a "printing apparatus" according to a second embodiment.

FIG. 6 is a front view that schematically illustrates the structure of the printer 101, which is a "printing apparatus" according to a second embodiment. The features of the second embodiment are as follows. A printing unit that is provided with an ejection head for ejecting UV ink is provided with a light irradiation device that causes the ejected UV ink to become fixed (cure) while ejection is being performed. Light irradiation units of the light irradiation device and the ejection head are mounted on a "moving section". The moving section is a "scanning section" that moves for scanning over the surface of the roll paper 1 in the Y-axis direction (first direction in the second embodiment).

A printer 101 is equipped with a printing unit 10*s* with a built-in "light irradiation device". The printer 101 is not equipped with the pretreatment unit 20 and the light irradiation device 30 of the printer 100. Therefore, the transportation path 60 is a path along which the roll paper 1 is transported from the feeding unit 40 to the reeling unit 50 via the printing unit 10*s*. Except for the above points of difference, the structure of the printer 101 is the same as that of the printer 100.

Figure 7:
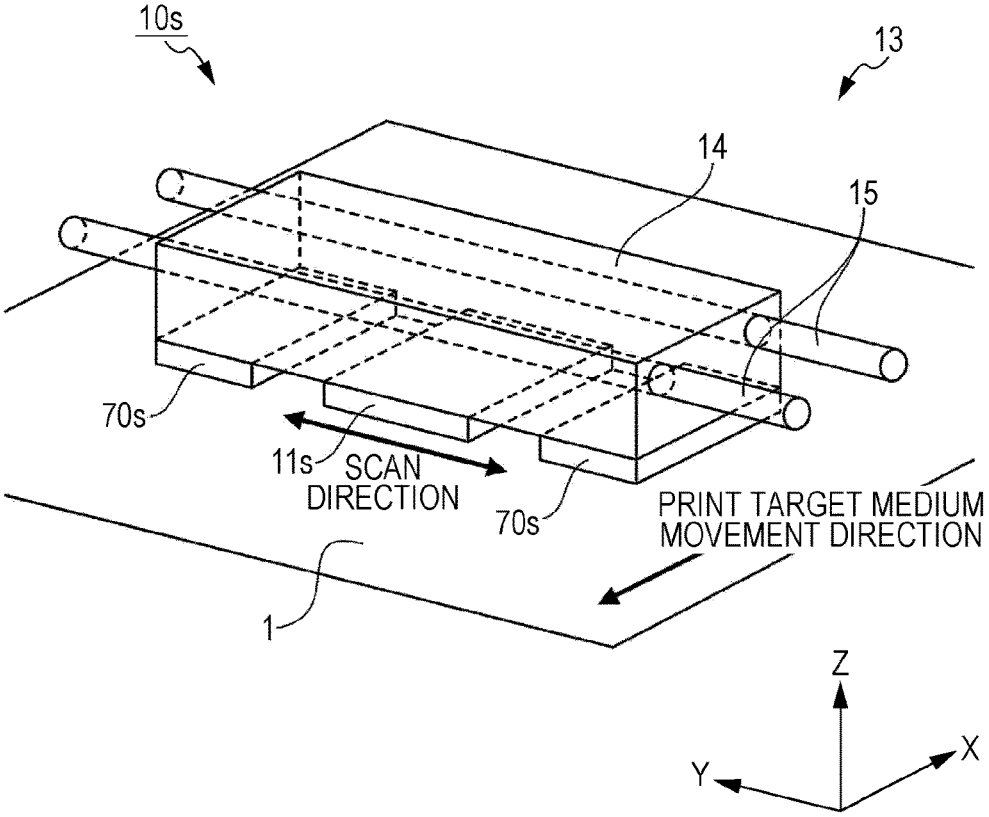
FIG. 7 is a perspective view that schematically the structure of a printing unit according to the second embodiment.

FIG. 7 is a perspective view that schematically the structure of the printing unit 10*s*. The printing unit 10*s* includes an ejection head 11*s*, UV irradiation units 70*s* as an example of the "light irradiation section", and a scanning unit 13, etc. The ejection head 11*s* is an ink-jet head that has plural nozzle lines made up of plural nozzles arranged in the X-axis direction. The printer 101 prints an image on the roll paper 1 by performing a combination of ejecting operation, which is the operation of ejecting UV ink from the nozzles while causing the ejection head 11*s* to reciprocate (move for scan) in the Y-axis direction (first direction), and transportation operation, which is the operation of causing the roll paper 1 to move in the X-axis direction (second direction in the second embodiment) orthogonal to the Y-axis direction (first direction).

The scanning unit 13 includes a carriage 14, a carriage guide 15, and a scan driver (not illustrated in the drawing), etc. The ejection head 11*s* and two UV irradiation units 70*s* are mounted on the carriage 14. The carriage 14 reciprocates (moves for scan) in the Y-axis direction along the carriage guide 15, which is made up of two guide shafts extending in the Y-axis direction. The scan driver includes a carriage motor, etc., which causes the carriage 14 to reciprocate (move for scan) along the carriage guide 15.

The UV irradiation unit 70*s* includes the same components as those of the UV irradiation unit 70, that is, an LED array, and the driver circuit 73, etc. That is, except for the direction of installation, the UV irradiation unit 70*s* has a structure defined by the arrangement of the LEDs 71 and the circuits explained earlier with reference to FIGS. 2A, 2B, 3A, and 3B. The two UV irradiation units 70*s* are provided next to the ejection head 11*s* at the respective two sides in the Y-axis direction. The arrangement plane of the array of the LEDs 71 of the two UV irradiation units 70*s* is provided at a facing position substantially in parallel with, and at a predetermined distance from, the surface of the roll paper 1 supported on the transportation path 60 at the printing unit 10*s*. In order to cause the UV ink having been ejected by the ejection head 11*s* to cure, the UV irradiation unit 70*s* emits light in the −Z direction, which is the main direction of irradiation toward the roll paper 1.

That is, the "light irradiation device" in the second embodiment includes the UV irradiation units 70*s*, the carriage 14, the carriage guide 15, and the scan driver, etc. The "moving section" is the scanning unit 13, which moves the relative position of the roll paper 1 and the UV irradiation units 70*s* in the Y-axis direction (first direction).

In the present embodiment, the scanning unit 13 functioning as the "moving section" executes movement in the first direction (Y-axis direction) over the roll paper 1. Therefore, it is possible to cause the UV ink having been applied onto the roll paper 1 to become fixed (cure) with greater uniformity by means of each row of the light sources of the same rank in the second direction (X-axis direction) orthogonal to the first direction (Y-axis direction), which is similar to the first embodiment.

The scope of the invention is not limited to the embodiments described above. The embodiments described above are open to various kinds of modification, improvement, and the like. Variation examples are described below. In the description below, the same reference numerals are assigned to the same components as those of the embodiments described above. A redundant explanation is not given here.

First Variation Example

Figure 8:
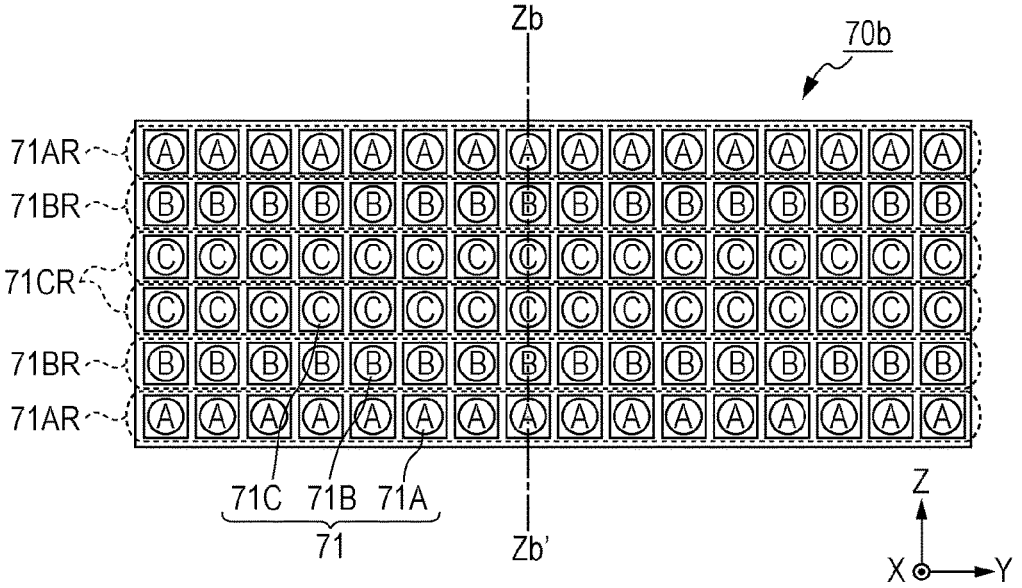
FIG. 8 is a front view that illustrates the structure of an LED array of an UV irradiation unit of a light irradiation device according to a first variation example.

FIG. 8 is a front view that illustrates the structure of an LED array of an UV irradiation unit 70*b* of a light irradiation device according to a first variation example. In the first embodiment, as illustrated in FIG. 2A, two light source rows 71AR made up of the LEDs 71A of the rank A are located at the center area in the Z-axis direction, one light source row 71BR made up of the LEDs 71B of the rank B is located next to and outside each one of the two light source rows 71AR in the Z-axis direction, and one light source row 71CR made up of the LEDs 71C of the rank C is located next to and outside each one of the two light source rows 71BR in the Z-axis direction. However, the scope of the invention is not limited to the array structure illustrated in FIG. 2A. A modified array structure illustrated in FIG. 8 may be adopted. In FIG. 8, two light source rows 71CR made up of the LEDs 71C of the rank C are located at the center area in the Z-axis direction (first direction), one light source row 71BR made up of the LEDs 71B of the rank B is located next to and outside each one of the two light source rows 71CR in the Z-axis direction (first direction), and one light source row 71AR made up of the LEDs 71A of the rank A is located next to and outside each one of the two light source rows 71BR in the Z-axis direction (first direction). That is, the LEDs 71 of the same rank are arranged in the Y-axis direction (second direction), which is orthogonal to the Z-axis direction (first direction). In the Z-axis direction (first direction), the LEDs 71 of different ranks are arranged in such a way that, in each column, irradiation intensity increases toward the outer LEDs in the array.

Figure 9:
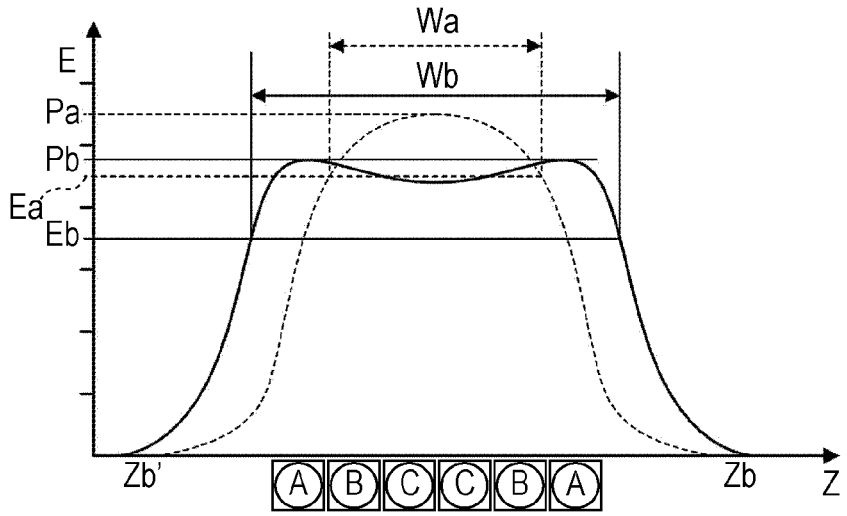
FIG. 9 is a graph that conceptually shows the distribution of the irradiation intensity of light emitted by an LED array according to the first variation example.

The distribution of the irradiation intensity of light emitted by the LEDs 71 with such a modified array is shown in the graph of FIG. 9. The graph of FIG. 9 shows the optical distribution of light emitted by the LEDs 71 arranged in the column Zb-Zb' of the LED array of the UV irradiation unit 70*b* illustrated in FIG. 8. The distribution of the amount of irradiation (the amount of photoreception) at positions of photoreception by the roll paper 1 in the Z-axis direction (first direction) is shown in this graph. For the purpose of comparison, the distribution curve of light emitted by the LED array of the UV irradiation unit 70 according to the first embodiment is shown by a broken line.

The LEDs 71A of the rank A, the LEDs 71B of the rank B, and the LEDs 71C of the rank C are arranged in the order illustrated beneath the graph. That is, the LEDs 71 are arranged in such a way that irradiation intensity increases toward the ends in the column Zb-Zb'. For this reason, though the peak Pb of irradiation intensity in this variation example is lower than the peak Pa of irradiation intensity in the first embodiment, the distribution in this variation example has a greater irradiation width. The first embodiment described earlier is effective for the fixation (curing) of UV ink that requires irradiation light having higher peak illuminance for the fixation (curing) (for example, irradiation light having irradiation intensity of Ea or greater in FIG. 9). In contrast, in this variation example, if light having lower peak illuminance is sufficient for the fixation (curing) (for example, irradiation light having irradiation intensity of Eb or greater in FIG. 9), it is possible to perform irradiation with a greater irradiation width (Wb>Wa) without any need for using irradiation light having higher peak illuminance. As described above, this variation example makes it possible to widen the range of light irradiation, resulting in more efficient fixation (curing) of UV ink.

Second Variation Example

Figure 10:
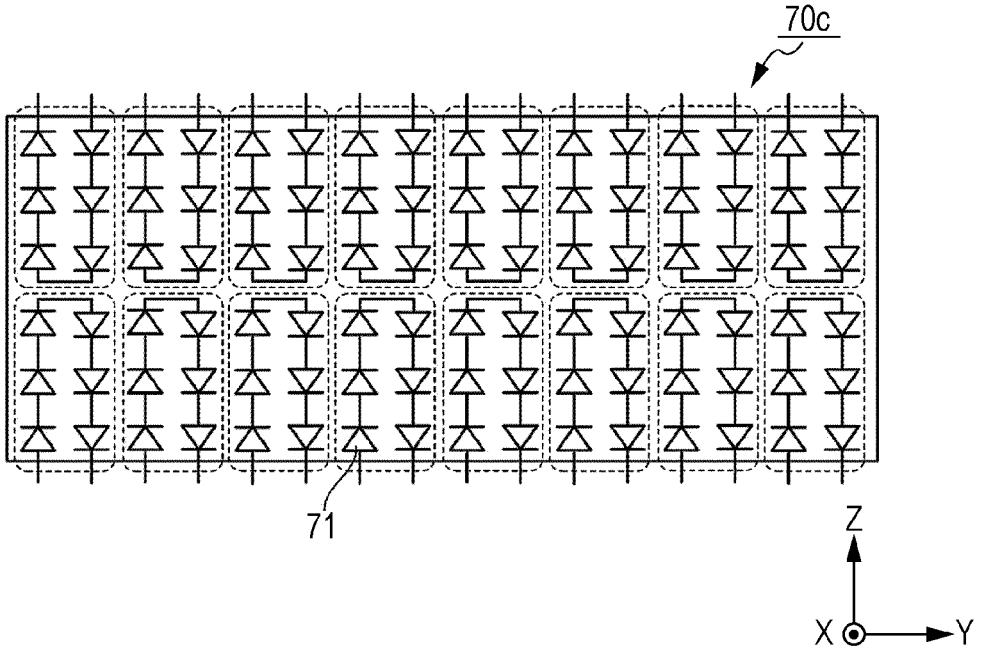
FIG. 10 is a circuit diagram that illustrates an electric connection relationship among LEDs in a UV irradiation unit of a light irradiation device according to a second variation example.

FIG. 10 is a circuit diagram that illustrates an electric connection relationship among the LEDs 71 in a UV irradiation unit 70*c* of a light irradiation device according to a second variation example. In the first embodiment, as illustrated in FIG. 3, LEDs 71 arranged in one column each in the Z-axis direction are connected in the forward direction to constitute one circuit group Sn, and plural circuit groups (groups S1 to S16) are arranged in the Y-axis direction (second direction). However, the scope of the invention is not limited to the structure illustrated in FIG. 3. The foregoing embodiment may be modified as long as plural circuit groups that can individually control an electric current flowing through the LEDs 71 are arranged in the second direction. For example, as illustrated in FIG. 10, the forward direction of the LEDs 71 arranged in the Z-axis direction may be alternated, and, each circuit group Sn may be made up of a pair of a going half column of LEDs 71 and a coming half column of LEDs 71 by, at the center portion in the Z-axis direction, establishing LED connection between the two of opposite directions adjacent to each other so as to obtain the forward connection of the LEDs 71 within each group electrically.

Such a structure makes wiring for connection of the circuit groups Sn and the driver circuit 73 easier.

This application claims priority to Japanese Patent Application No. 2015-001355 filed on Jan. 7, 2015. The entire disclosure of Japanese Patent Application No. 2015-001355 is hereby incorporated herein by reference.

What is claimed is:

1. A light irradiation device, comprising:

a light irradiation section that applies light to photo-curable ink having been applied onto a medium; and a moving section that moves a relative position of the medium and the light irradiation section in a first direction;

wherein the light irradiation section includes, a first light source row formed by arranging plural first light sources, irradiation intensity of which falls within a first predetermined range, in a second direction orthogonal to the first direction; and a second light source row located next to the first light source row and formed by arranging plural second light sources, irradiation intensity of which falls within a second predetermined range, in the second direction, the second predetermined range being different than the first predetermined range, the first predetermined range and the second predetermined range collectively maintaining a total energy of photoreception by the medium above a threshold for curing, with variations of the energy of photoreception across the medium in the second direction being within a predetermined amplitude.

2. The light irradiation device according to claim 1, wherein light sources of the light irradiation section, which include the first light sources and the second light sources, are divided into plural row groups in the second direction; and wherein the light irradiation section includes a driver circuit that drives and controls the light sources in each of the groups.

3. A printing apparatus, comprising:

the light irradiation device according to claim 2; and a printing section that applies the photo-curable ink onto the medium.

4. The printing apparatus according to claim 3, wherein the moving section moves the medium in relation to the light irradiation section.

5. The printing apparatus according to claim 3,
wherein the printing section includes an ejection head that ejects the photo-curable ink onto the medium; and
wherein the ejection head and the light irradiation section can be moved in the second direction.

6. The light irradiation device according to claim 1,
wherein the light irradiation section further includes a third light source row formed by arranging the second light sources in the second direction and located next to the first light source row;
wherein the irradiation intensity of the first light source row is greater than the irradiation intensity of the second light source row and irradiation intensity of the third light source row; and
wherein the first light source row is located between the second light source row and the third light source row.

7. A printing apparatus, comprising:
the light irradiation device according to claim 6; and
a printing section that applies the photo-curable ink onto the medium.

8. The printing apparatus according to claim 7,
wherein the moving section moves the medium in relation to the light irradiation section.

9. The printing apparatus according to claim 7,
wherein the printing section includes an ejection head that ejects the photo-curable ink onto the medium; and
wherein the ejection head and the light irradiation section can be moved in the second direction.

10. The light irradiation device according to claim 1,
wherein the light irradiation section further includes a third light source row formed by arranging the second light sources in the second direction and located next to the first light source row;
wherein the irradiation intensity of the first light source row is less than the irradiation intensity of the second light source row and irradiation intensity of the third light source row; and
wherein the first light source row is located between the second light source row and the third light source row.

11. A printing apparatus, comprising:
the light irradiation device according to claim 10; and
a printing section that applies the photo-curable ink onto the medium.

12. The printing apparatus according to claim 11,
wherein the moving section moves the medium in relation to the light irradiation section.

13. The printing apparatus according to claim 11,
wherein the printing section includes an ejection head that ejects the photo-curable ink onto the medium; and
wherein the ejection head and the light irradiation section can be moved in the second direction.

14. The light irradiation device according to claim 1,
wherein the first light sources and the second light sources are light emitting diodes.

15. A printing apparatus, comprising:
the light irradiation device according to claim 14; and
a printing section that applies the photo-curable ink onto the medium.

16. The printing apparatus according to claim 15,
wherein the moving section moves the medium in relation to the light irradiation section.

17. The printing apparatus according to claim 15,
wherein the printing section includes an ejection head that ejects the photo-curable ink onto the medium; and
wherein the ejection head and the light irradiation section can be moved in the second direction.

18. A printing apparatus, comprising:
the light irradiation device according to claim 1; and
a printing section that applies the photo-curable ink onto the medium.

19. The printing apparatus according to claim 18,
wherein the moving section moves the medium in relation to the light irradiation section.

20. The printing apparatus according to claim 18,
wherein the printing section includes an ejection head that ejects the photo-curable ink onto the medium; and
wherein the ejection head and the light irradiation section can be moved in the second direction.

* * * * *